US005251549A

United States Patent [19]

Boisseau et al.

[11] Patent Number: 5,251,549

[45] Date of Patent: Oct. 12, 1993

[54] MULTI-PERFORATED DIVIDED PROPELLENT POWDER STICKS, MANUFACTURING EQUIPMENT AND ITS USE

[75] Inventors: Jean Boisseau, Martignas sur Jalles; Jean-Louis Paulin, Ballancourt; Christiane Reynaud, Mennecy, all of France

[73] Assignee: Societe Nationale des Poudres et Explosifs, Paris, France

[21] Appl. No.: 912,905

[22] Filed: Jul. 13, 1992

[30] Foreign Application Priority Data

Aug. 1, 1991 [FR] France ..... 91 09800

[51] Int. Cl.[5] ..... C06B 45/00

[52] U.S. Cl. ..... 102/289; 102/290; 102/291

[58] Field of Search ..... 102/284, 290, 291, 289

[56] References Cited

U.S. PATENT DOCUMENTS

| | | | |
|---|---|---|---|
| 3,256,819 | 6/1966 | Leeper | 102/98 |
| 3,492,815 | 2/1970 | McCullough | 60/39.47 |
| 4,386,569 | 6/1983 | Deas | 102/292 |
| 4,466,352 | 8/1984 | Dalet et al. | 102/288 |
| 4,581,998 | 4/1986 | Horst, Jr. et al. | 102/289 |
| 4,615,270 | 10/1986 | Bell | 102/289 |
| 4,627,352 | 12/1986 | Brachert et al. | 102/290 |
| 4,870,884 | 10/1989 | Schubart et al. | 86/20.12 |

*Primary Examiner*—Peter A. Nelson
*Attorney, Agent, or Firm*—Bucknam and Archer

[57] ABSTRACT

The present invention relates to propellent powders in multi-perforated sticks (1) divided by radial slits (7) cutting the peripheral channels (6) of the stick (1) but allowing a continuous cover (8) to remain around its central channel (5). The invention also relates to equipment for obtaining such sticks, comprising:—a drive shaft (17) carrying circular cutting members (18),—a positioning shaft (19) carrying rollers (20) and a thrust shaft (21) carrying rollers (22). The sticks (1) advantageously constitute bundles for artillery ammunition which divide up into elementary particles at the moment of firing.

6 Claims, 8 Drawing Sheets

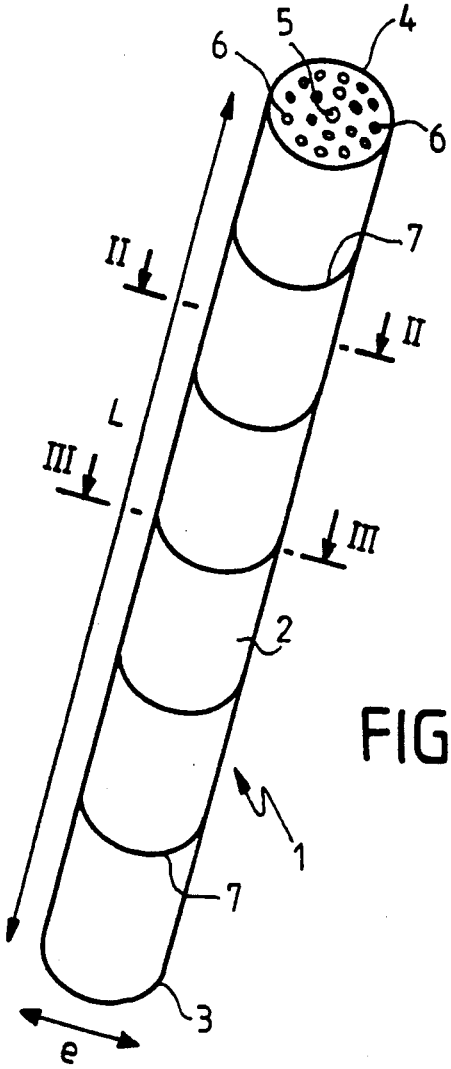
FIG_1
FIG_2
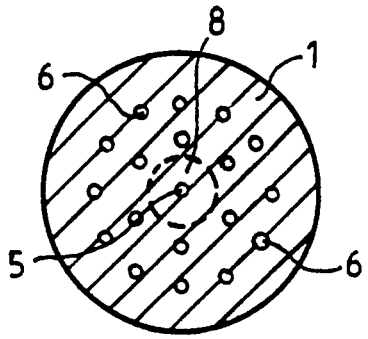
FIG_3
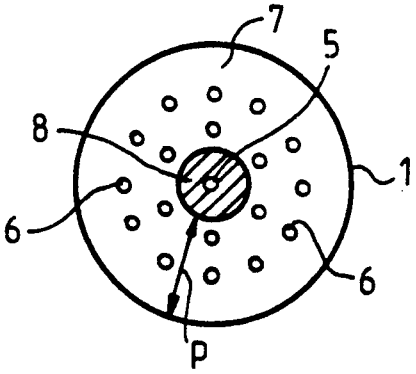
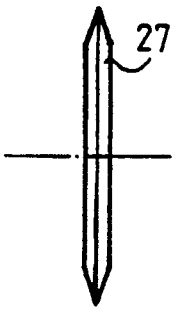
FIG_10

MULTI-PERFORATED DIVIDED PROPELLENT POWDER STICKS, MANUFACTURING EQUIPMENT AND ITS USE

The present invention relates to the field of propellent powders intended for artillery fillings and to their manufacture.

More precisely, the invention relates to propellent powders in the form of elongate multi-perforated cylindrical sticks comprising radial slits, which leave a continuity of material remaining along entire length of the stick. It is in this sense that the word "divided" should be understood throughout the present application. Furthermore, in the sense of the present description, the word "radial" should be understood to mean that the slits are located in planes perpendicular to the generatrices of the cylindrical stick.

The invention also relates to equipment specific to the last step in the manufacture of the powder sticks according to the invention and to its use in a powder manufacturing method.

Conventionally, artillery ammunition has been filled propellant shell case. This type of filling has the disadvantage of allowing numerous dead volumes to remain and of not allowing a good filling of the shell case.

In order to improve the performance of the ammunition without changing the dimensions which are imposed by the weapon system, powder geometry configurations have been sought which allow better filling of the shell case in a reproducible manner.

Thus, those skilled in the art tended towards the use, for artillery ammunition, of powders in the form of elongate sticks which are arranged as a compact bundle allowing the insertion, into a given volume, of larger quantities of propellant material. This solution is for example described in the French patent 1 605 454 or the European patent 0 090 155.

In order that such a bundled powder filling may burn with sufficient gas release rate to comply with the requirements of artillery firings, it is necessary that each powder stick be pierced by one or more hollow longitudinal channels parallel with the generatrices of the stick and that the combustion propagates instantaneously to all of the propellant material, as happens with a filling of loose powder particles. The use in artillery fillings of such powder sticks which are called "multi-perforated", however, gives rise to a difficult problem. During ignition, the pressure suddenly increases in the channels and causes, if measures are not taken to balance pressures, random and non-reproducible fractures of the powder stick. The fragmentation of the stick into smaller particles is in itself a phenomenon favourable to the use of the filling in artillery ammunition, as those skilled in the art will thus find gas release rates comparable with those of conventional fillings of loose powder particles. On the other hand, it is the non-reproducible nature of this fragmentation which is a hindrance to those skilled in the art, as they cannot, under these conditions, guarantee the performance of the ammunition. For powder sticks comprising one or three channels, the usual solution is to open the channels with longitudinal slits. This solution cannot however be used when the stick comprises more than three channels.

In order to overcome this disadvantage, another solution, proposed for example in the U.S. Pat. Nos. 660,567 and 660,568, consists of forming true vents in the powder stick in the form of windows produced by the removal of material, the said windows intersecting with all of the channels of the sticks but allowing material to remain on the sides in order to ensure the continuity of the powder stick. In this solution the channels allow the propagation of the ignition without an excessive rise in the pressure inside the stick because of the vents. One disadvantage remains however because, if the ignition occurs well over the entire length of the stick, the latter does not usually fragment and remains in the combustion chamber, which is undesirable. Furthermore, this solution involving machining is expensive in terms of its practical implementation.

A different solution, described in the European patent applications 0 304 099 and 0 304 100, has been proposed. This solution consists of powder sticks which are multi-perforated and prefragmented due to transverse incisions cutting all of the channels of the stick, the incisions being made in a way similar to that of the vents which are the subject of the U.S. Pat. Nos. 660,567 and 660,568, but without removal of material. This solution certainly allows powder sticks to be obtained whose fragmentation is reproducible, but allows two disadvantages to remain. On one hand, it has been observed that the fragmentation of such sticks occurs only at the end of combustion when the pressure in the chamber has reached a high value such that the favourable effect related to the fragmentation of the stick occurs only in a delayed manner. On the other hand, the industrial manufacture of such sticks is difficult and this limits the possibilities of development of this solution.

Those skilled in the art are therefore still seeking multi-perforated powder sticks able to constitute bundled fillings for artillery ammunition which fragment in a reproducible manner from the start of combustion of the filling and which are easy to manufacture on an industrial scale.

The provide of the present invention is precisely to propose such powder sticks.

The invention therefore relates to propellant powders in the form of multi-perforated sticks of cylindrical shape in which the length L of the generatrices is at least equal to three times the thickness e of a base of the cylinder, having a central channel parallel with the generatrices of the stick and a plurality of peripheral channels parallel with said central channel and disposed between the central channel and the outer surface of the said stick, and comprising radial slits perpendicular to the generatrices of the stick and formed starting from the outer surface of the stick, the powder being characterized in that the slits are continuous over the entire outer surface of the stick and have a depth p such that they cut at least some of the peripheral channels but such that they allow a continuous cover of propellant material to remain at least around the said central channel.

According to a first preferred embodiment of the invention, the slits are incisions made without removal of material.

According to a second preferred embodiment of the invention, the shape of the powder stick is that of a cylinder of revolution.

According to a third preferred embodiment of the invention, the slits allow a continuous cover of propellent material to remain only around the central channel.

The invention also relates to equipment intended for cutting the continuous radial slits on a multi-perforated cylindrical powder stick, characterized in that it comprises:

(a) a drive shaft carrying circular cutting members, (b) a positioning shaft comprising circular rollers disposed opposite the said cutting members, the axis of the positioning shaft being located in the same plane P as the axis of the drive shaft, (c) a thrust shaft, mobile in the vertical direction between a high position and a low position, the axis of the thrust shaft being disposed in a plane perpendicular to the said plane P and above the space contained between the drive shaft and the positioning shaft, the thrust shaft comprising circular rollers disposed opposite the spaces contained between the cutting members, (d) a feed system allowing powder sticks to be deposited, one by one, between the drive shaft and the positioning shaft when the thrust shaft is in the high position.

According to a preferred embodiment, the cutting members are constituted by toothless circular cutters.

According to another preferred embodiment of the invention, the thrust shaft is driven and the positioning shaft rotates freely.

According to a third preferred embodiment of the invention, the rollers carried by the positioning shaft and by the thrust shaft are detachable and identical.

Finally, the invention also relates to the use of the equipment described above in a method of manufacturing multi-perforated propellant powder sticks of cylindrical shape and comprising continuous radial slits which allow a continuous cover of propellant material to remain surrounding at least the central channel of the said sticks.

A detailed description of the preferred embodiment of the invention is given below with reference to FIGS. 1 to 13.

FIG. 1 is a perspective view of a powder stick according to the invention.

FIG. 2 is a cross-section through II—II of the stick shown in FIG. 1.

FIG. 3 is a cross-section through III—III of the stick shown in FIG. 1.

FIG. 10 is a diagrammatic representation of a circular cutter carried by the drive shaft.

Figure 11:
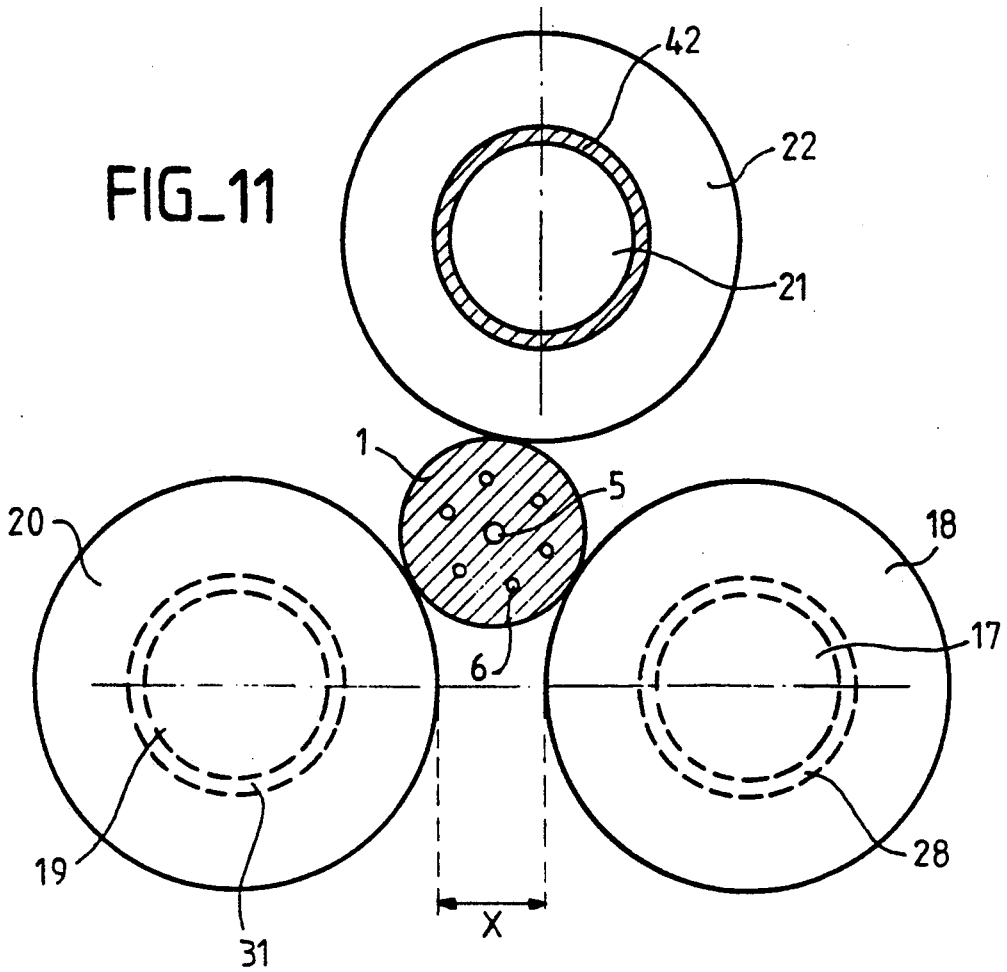
Figure 12:
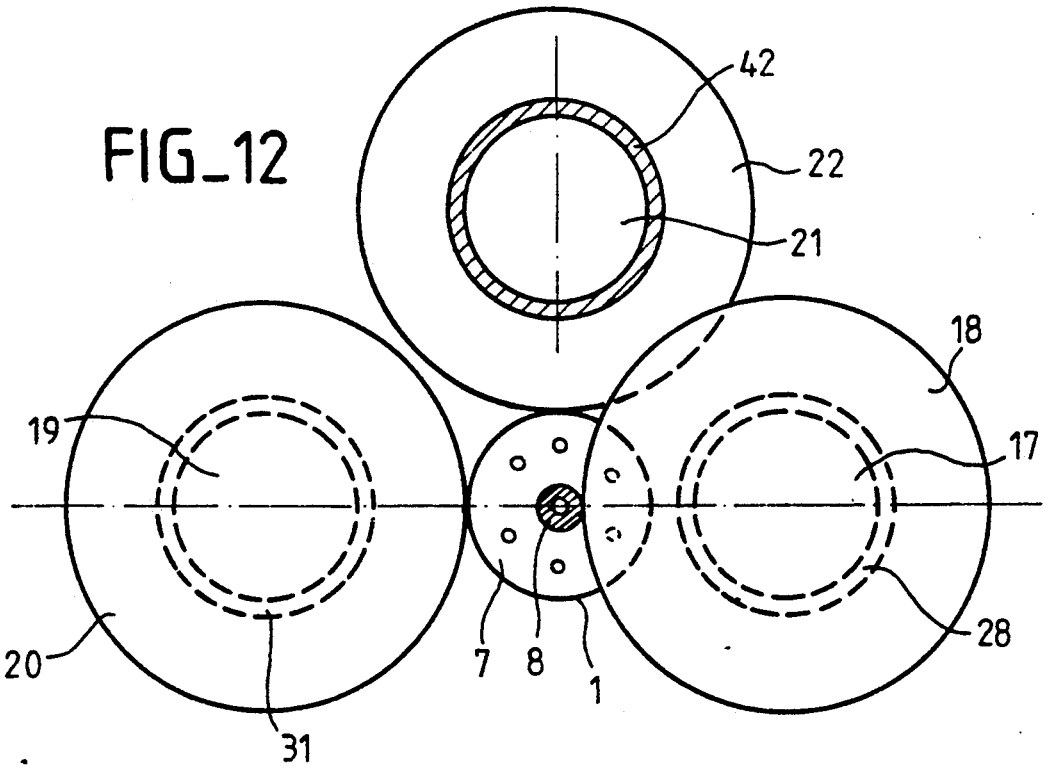

FIGS. 11 and 12 shown, in a diagrammatic manner, the passage of a powder stick through equipment according to the invention.

Figure 13:
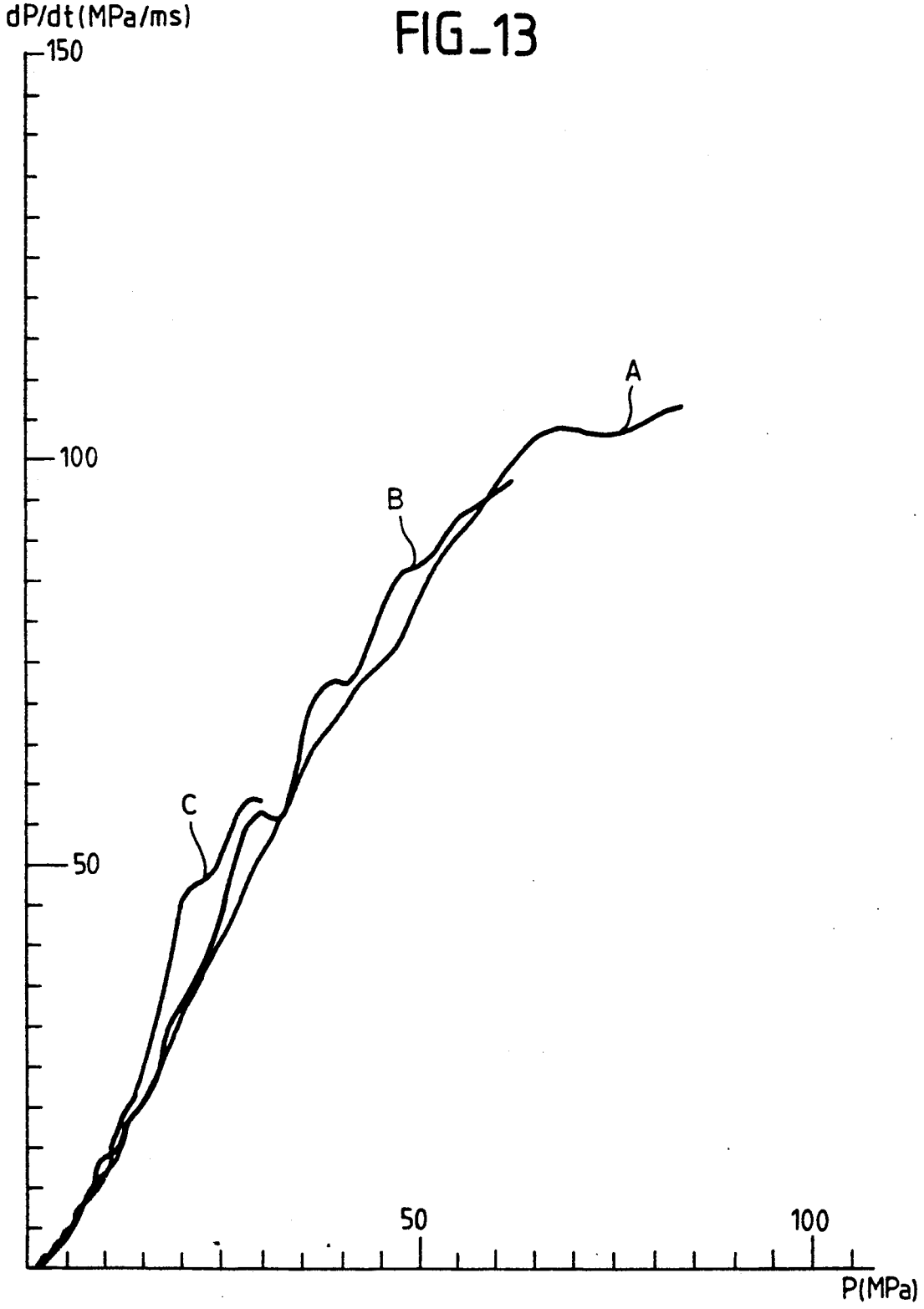

FIG. 13 illustrates the firing results described in Example 1.

The invention therefore relates to propellant powders put into the form of elongated multi-perforated cylindrical sticks.

As constituent propellant material of the powders according to the invention it is possible to use nitrocellulose, alone or mixed with one or more compounds chosen from the group constituted by the nitrated oils such as nitroglycerin or by the nitramines such as nitroguanidine, hexogen, octogen or by energizing nitrated organic compounds such as dinitrotoluene, pentrite, dinitroglycolurile, polyvinyl nitrate or dinitropolystyrene.

It is also possible to use, as propellant material, energizing mixtures constituted by an inert binder such as a polyester or a polyurethane comprising in particular polybutadiene units and by at least one nitramine. The powders according to the invention are put in the shape of elongate multi-perforated cylindrical sticks. FIG. 1 shows a powder stick 1 according to the invention. The stick being cylindrical, it has a length L corresponding to the length of the generatrices which define its outer surface 2 and a thickness e corresponding to the largest dimension of its bases 3 and 4. The stick 1 is said to be elongate when its length L is at least three times its thickness e. Preferably, the stick 1 has the shape of a cylinder of revolution as shown in FIG. 1 and in this case its thickness e is equal to the diameter of its bases 3 and 4. In this case the slits are truly radial in the geometric sense of the term.

The stick 1 has a hollow central channel 5 which is parallel to the generatrices of the stick 1, this central channel 5 extending over the entire length of the stick. The stick 1 also has a plurality of peripheral channels 6 parallel to the central channel 5 and disposed between the central channel 5 and the outer surf ace 2 of the said stick. The peripheral channels 6 also extend over the entire length of the stick 1 and their number is generally chosen such that they constitute, with the central channel, the 7-hole, 19-hole or 37-hole geometrical configurations well known to those skilled in the art.

A powder stick 1 according to the invention also comprises radial slits 7 perpendicular to the generatrices of the said stick and formed starting from the outer surface 2 of the said stick.

In a characteristic manner, these slits 7 are continuous over the entire outer surface of the stick 1 such that each slit 7 makes a complete circuit of the stick 1 and they have a depth p such that they cut at least certain of the said peripheral channels 6 but such that they allow a continuous cover 8 of propellant material to remain at least around the central channel 5.

According to a preferred embodiment of the invention, the slits 7 are simple incisions made without removal of material. According to another preferred embodiment of the invention, shown in FIGS. 2 and 3, the slits 7 cut all of the peripheral channels 6 and allow the continuous cover 8 of propellant material to remain only around the single channel 5. Even though this embodiment is not mandatory with respect to the present invention, applicants have however noted that it is this embodiment which results in the best fragmentation of the stick from the start of the ignition.

The slits 7 are disposed along the stick 1 as desired by those skilled in the art as a function of their requirements. However, these slits 7 will advantageously be regularly spaced along the entire length of the stick and the distance separating two consecutive slits will preferably be between one and three times the thickness e of the stick 1.

The powder sticks according to the invention are particularly intended to be used in bundles as propellant filling for artillery ammunition. They may equally well be used in ammunition with conventional metal shell cases and in ammunition with combustible or semi-combustible shell cases.

As will be seen from the examples given at the end of the description, the use of powder sticks according to the invention allows, with respect to a loose filling, an increase in the quantity of energizing material inserted into a shell case of given volume while retaining the combustion law of a loose filling because the divided sticks according to the invention separate themselves, at the site of the slits 7, into elementary particles from the start of ignition, which is not the case for the sticks proposed in the prior art. The moment of division into elementary particles can be adjusted by the choice of the thickness of the continuous cover 8 of propellant material.

The invention also relates to the apparatus intended for cutting continuous radial slits on a multi-perforated cylindrical powder stick.

The apparatus 10 according to the invention is shown in FIGS. 4 to 10. Referring more particularly to FIGS. 4, 5, 6 and 7, it is observed that the apparatus 10 according to the invention is disposed inside a frame 11, generally metallic, standing on three feet 12, 13 and 14 and closed at the front by a transparent cover 15 and at the rear by a cover 16 which is also transparent.

In a characteristic manner, the apparatus according to the invention comprises four fundamental elements.

(a) a drive shaft 17 carrying circular cutting members 18, (b) a positioning shaft 19 comprising circular rollers 20 disposed opposite the said cutting members 18, (c) a thrust shaft 21, mobile in the vertical direction and comprising circular rollers 22 disposed opposite the spaces 23 contained between the cutting members 18, (d) a feed system 24 allowing powder sticks to be deposited, one by one, between the drive shaft 17 and the positioning shaft 19.

Figure 7:
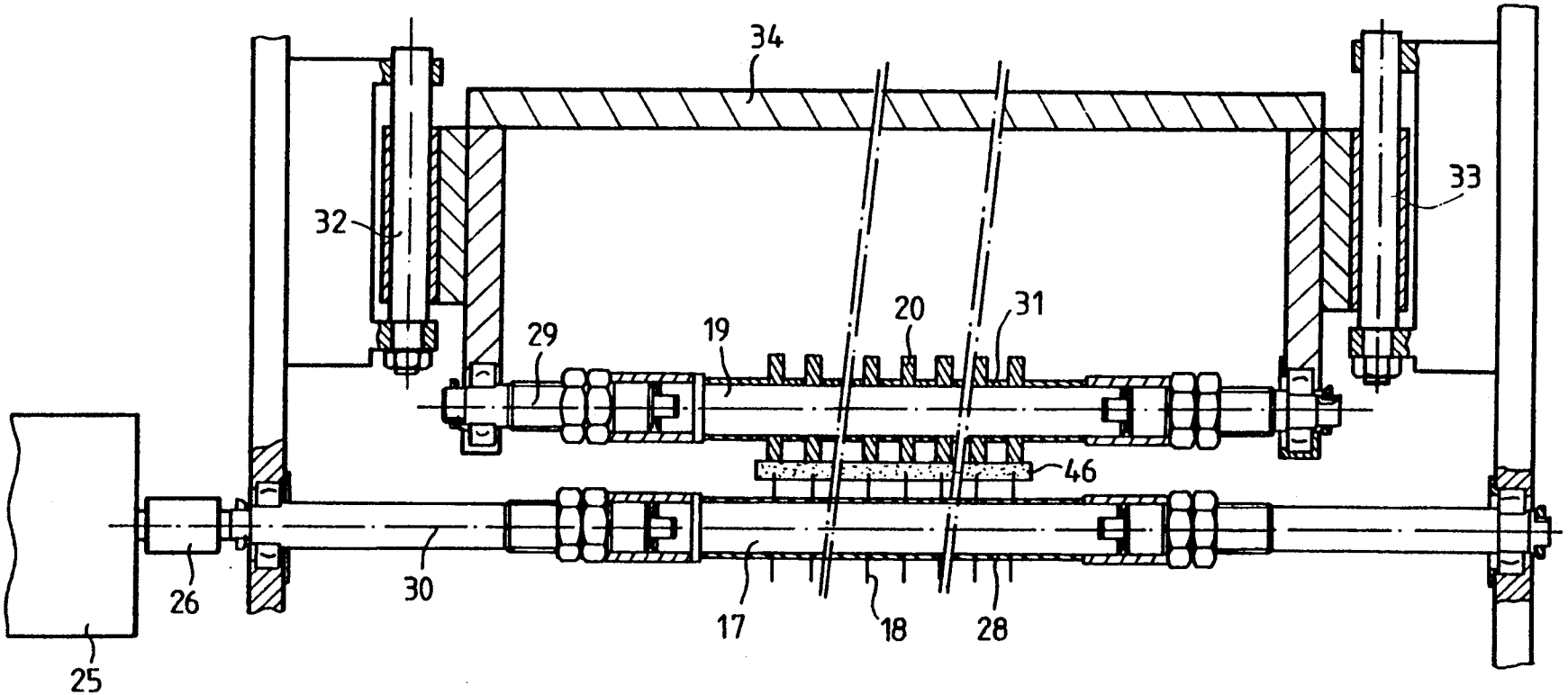
FIG. 7 is a plan view showing the drive shaft and the positioning shaft of the said equipment.
Figure 8:
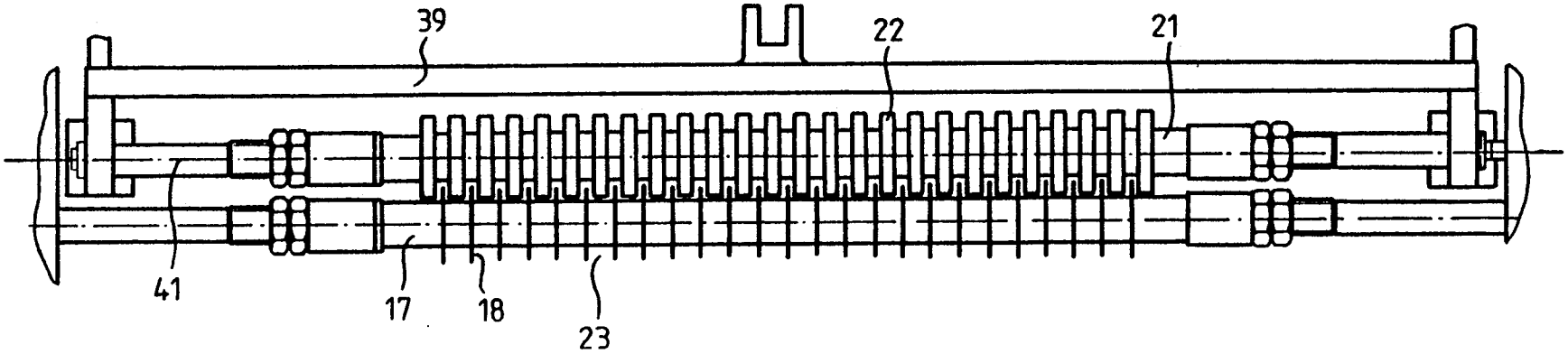
FIG. 8 is a front view showing the drive shaft and the thrust shaft of said equipment.
Figure 9:
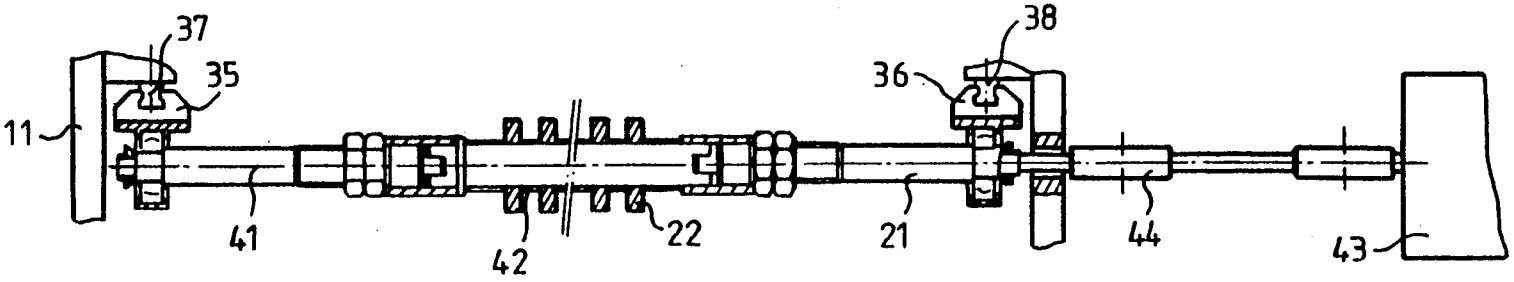
FIG. 9 is a plan view of the thrust shaft shown in FIG. 8.

Reference is now made more particularly to FIGS. 7, 8 and 9 for a detailed description of the drive shaft, the positioning shaft and the thrust shaft according to the invention.

The apparatus 10 according to the invention therefore comprises a drive shaft 17 which is mandatorily a motor-driven shaft and which is coupled to a motor unit 25 by means of a double cardan joint 26. This drive shaft 17 carries circular cutting members 18. These cutting members 18 are advantageously constituted by circular cutters which, preferably, are toothless circular cutters 27, as shown in FIG. 10. The cutting members 18 can be fixed definitively to the drive shaft 17 but, preferably, they will be fixed in a detachable manner by means of spacers 28 in order to be able, as a function of requirements, to change the cutting member or to modify the spacing between these members.

Beside the drive shaft 17 there is a positioning shaft 19 whose axis 29 is located in the same plane P as the axis 30 of the drive shaft 17. In general, this plane P will be a horizontal plane. The positioning shaft comprises circular rollers 20 disposed opposite the cutting members 18. These rollers 20 can be an integral part of the shaft 19 while constituting ribs carried by this shaft but, according to a preferred embodiment of the invention, these rollers 20 constitute separate detachable parts held in place by spacers 31 in such a way as to allow those skilled in the art to change them according to their manufacturing requirements. For the same purpose, the position of the axis 29 of the positioning shaft 19 preferably has adjustable spacing with respect to the axis 30 of the drive shaft 17, for example by means of micrometer screws 32 and 33 supporting the frame 34 carrying the positioning shaft 19.

The apparatus 10 according to the invention also comprises a thrust shaft 21 which is mobile in the vertical direction between a high position and a low position.

Figure 4:
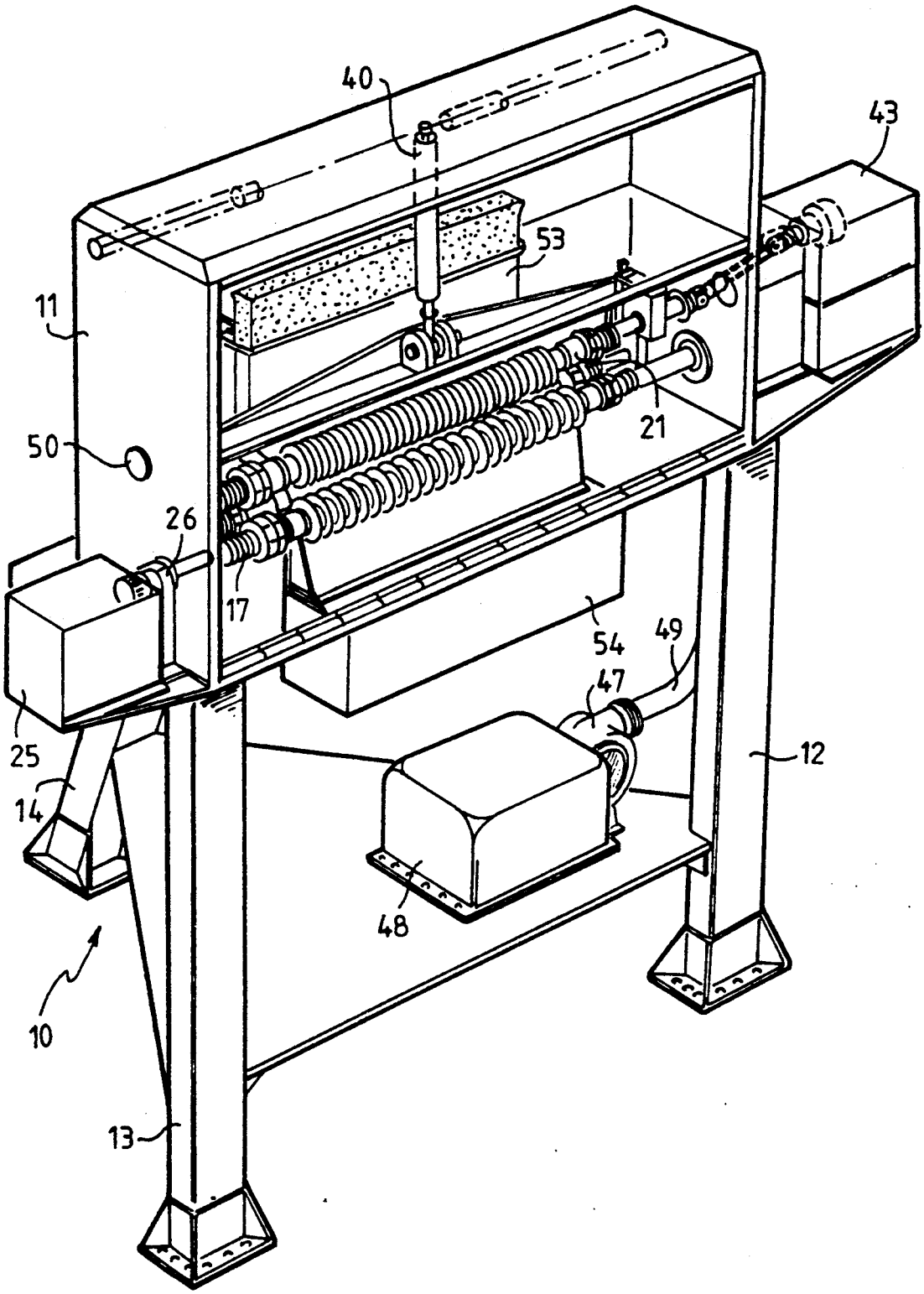
FIG. 4 is a perspective view of equipment according to the invention.
Figure 5:
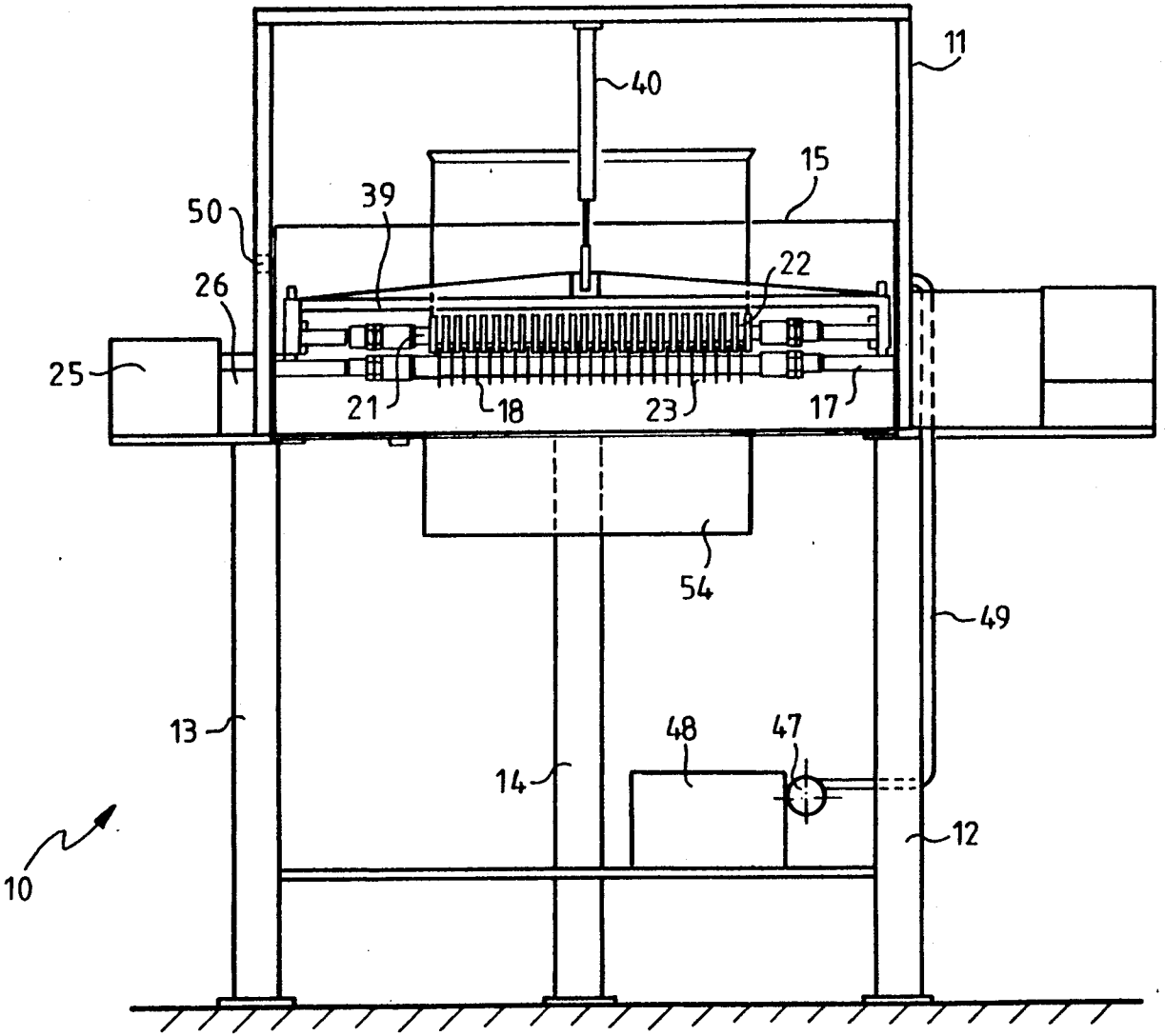
FIG. 5 is a front view of the equipment shown in FIG. 3.

In order to do this, the thrust shaft 21 may, as shown for example in FIGS. 9 and 5, carry slides 35 and 36 at its ends, these slides being respectively engaged in guidance rails 37 and 38 carried by the frame 11. Furthermore the thrust shaft 21 is carried by a frame 39 connected to a jack 40, for example an electric jack.

The axis 41 of the thrust shaft 21 is disposed in a plane perpendicular to the plane P defined by the axes 29 and 30 of the positioning and drive shafts and is placed above the space included between the positioning shaft 19 and the drive shaft 17. The thrust shaft 21 comprises circular rollers 22 disposed opposite spaces 23 contained between the cutting members 18 carried by the drive shaft 17. These rollers 22 have a thickness such that they may penetrate inside the said spaces 23, as shown in FIG. 8. The rollers 22 can be an integral part of the thrust shaft 21 by constituting ribs carried by this shaft but, according to a preferred embodiment of the invention, they can constitute separate detachable parts held in place by spacers 42 in such a way as to allow those skilled in the art to change them according to their manufacturing requirements. When the rollers 20 carried by the positioning shaft 19 are also detachable and the positioning shaft 19 has adjustable spacing with respect to the drive shaft 17, those skilled in the art have equipment of the universal type allowing the processing of sticks having very different dimensions and geometrical configurations. This is one of the useful advantages of the apparatus according to the invention. In this case the rollers 20 carried by the positioning shaft 19 are advantageously identical to the rollers 22 carried by the thrust shaft 21, as shown in the figures.

The adjustment of the high position of the thrust shaft is carried out in a manner such that, when the thrust shaft 21 is in the high position, the feed system 24 can deposit a powder stick between the drive shaft 17 and the positioning shaft 19. The adjustment of the low position of the thrust shaft is carried out in a manner such that the outer surface of the rollers 22 carried by this shaft remains in contact with the powder stick at the end of cutting, as will be explained a little later. In practice, the low position will be adjusted in a manner such that the minimum distance between the plane P defined above and the outer surface of the rollers 22 is equal to the radius of the powder stick to be processed.

According to the invention it is mandatory that the drive shaft 17 be a motor-driven shaft; the positioning shaft 19 and the thrust shaft 21 may either be motor-driven or may rotate freely. It is however recommended that a second shaft should also be a motor-driven shaft. According to a preferred embodiment, shown in the figures, the positioning shaft 18 is free to rotate while the thrust shaft 21 is a motor-driven shaft which is coupled to a motor unit 43 by means of a double cardan joint 44.

Figure 6:
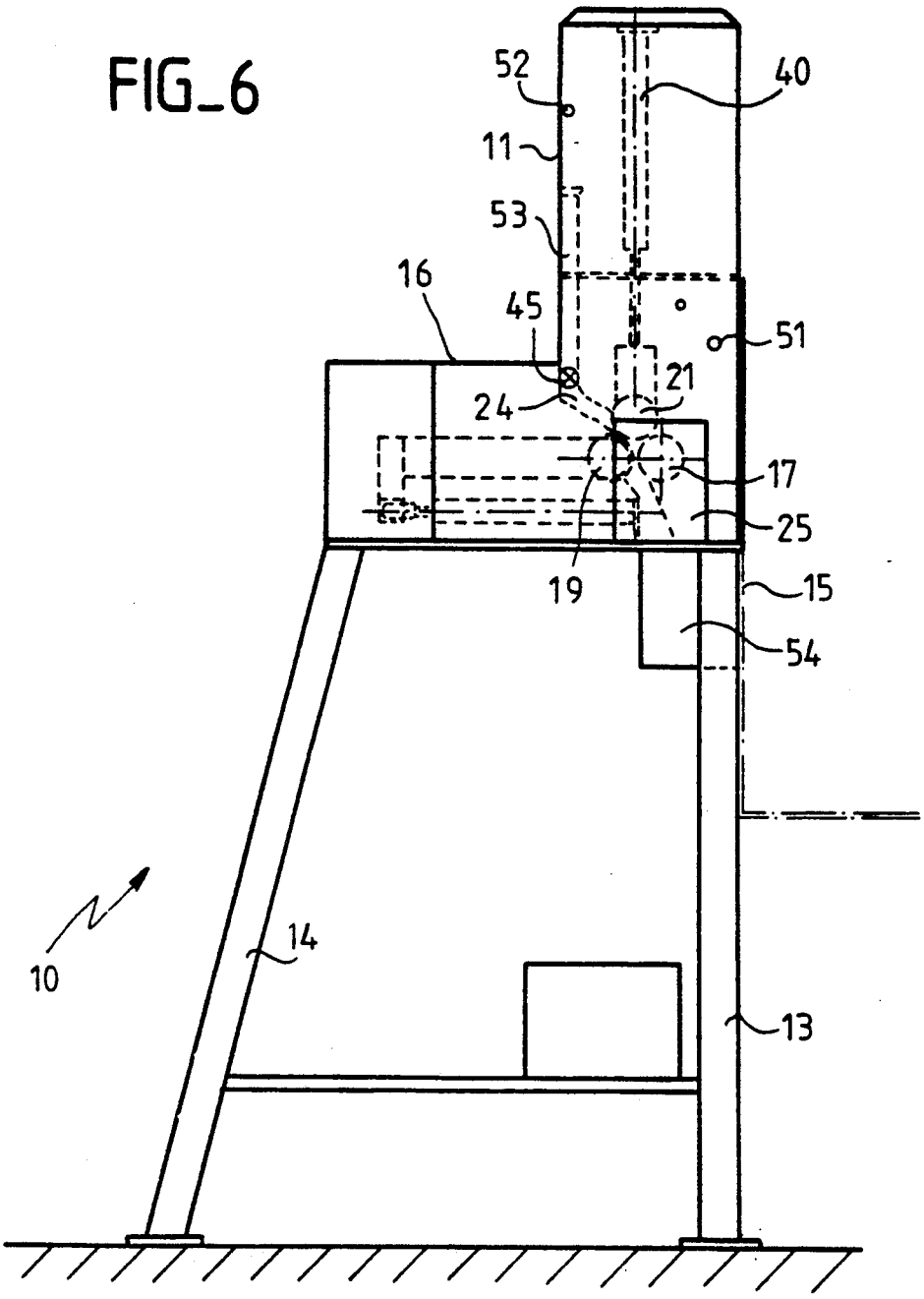
FIG. 6 is a side view of the equipment shown in FIG. 4.

Finally, the apparatus 10 according to the invention comprises a feed system 24 allowing the depositing, one by one, of powder sticks 46 between the drive shaft 17 and the positioning shaft 19 when the thrust shaft 21 is in the high position. Such a system 24 may, for example and as shown in FIG. 6, be constituted by a hopper 53 comprising in its bottom section a barrel 45 allowing the powder sticks 46 to be taken one by one. The powder sticks are brought into the hopper by means of a horizontal belt which is not shown in the figure. Each time that the thrust shaft 21 is in the high position, a rotation of the barrel allows one stick 46 to be placed between the drive shaft 17 and the positioning shaft 19, as shown in FIG. 7. Advantageously, the hopper 53 will be able to comprise a heating device allowing the maintaining of a temperature which can be as high as 60° C. in order to prevent the waiting powder sticks from cooling down too much and becoming too hard.

The apparatus 10 also comprises, in a preferred manner, an air cooling device for the shafts 17, 19 and 21. Such a device may, for example and as shown in FIG. 5, comprise a fan 47 coupled to a cooling unit 48 and to an air pipe 49 taking cool air around the shafts 17, 19 and 21, an air outlet opening 50 completing the device. Furthermore, as shown in FIG. 6, extinguisher discharge tubes 51 and 52 will advantageously complete the safety installations of the equipment according to the invention.

The invention also relates to the use of apparatus 10 according to the invention in a method of manufacturing propellant powders in the form of multi-perforated cylindrical sticks comprising continuous radial slits which allow a continuous cover of propellent material to remain surrounding at least the central channel of the said sticks.

Those skilled in the art know how to obtain propellant powders in the form of multi-perforated cylindrical sticks 1 of predetermined length by means of a continuous or discontinuous method.

These sticks 1 are then placed in the hopper 53 of the equipment 10. When the thrust shaft 21 is in the high position, the feed system 24 allows one stick 1 to be placed between the drive shaft 17 and the positioning shaft 19 in contact with the cutting members 18 and with the rollers 20 while the thrust shaft 21 is lowered again such that the rollers 22 also come into contact with the stick 1. FIG. 11 is a diagrammatic representation of a stick 1 just before the cutting of the slits 7 begins, the three shafts 17, 19 and 21 rotating in the anti-clockwise direction, a rotational speed close to 200 revolutions per minute generally being preferred. The minimum spacing x between the outer surface of the rollers 20 carried by the positioning shaft 19 and the outer surface of the cutting members 18 carried by the drive shaft 17 corresponds to the formula $$X=(de-da)/2,$$

in which: de represents the outer diameter of the stick 1, da represents the diameter of the continuous cover 8 of propellant material which it is desired to retain around the central channel 5 of the stick 1. It is observed that for a given stick the apparatus according to the invention allows, in its preferred embodiment, the adjustment at will of the thickness of the continuous cover 8 of propellant material, which allows the adjustment at will of the moment of division of the stick into elementary particles.

The thrust shaft 21 continues to descend and the members 18 cut a series of radial slits 7 on the stick 1. With the stick 1 in rotation about itself but not being able to move parallel to the drive shaft 17 because of the pressure applied on it by the thrust shaft 21, each slit 7 goes all around the stick 1 in a plane perpendicular to its axis and penetrates more and more which causes the descent of the stick 1 until it passes between the drive shaft 17 and the positioning shaft 19.

FIG. 12 is a diagrammatic representation of a stick 1 at the moment at which it passes between the drive shaft and the positioning shaft. Taking account of the determination of the spacing x between the two shafts it is observed that at this stage the slits 7 have a depth p such that they only allow a cover of propellant material of diameter da to remain around the central channel 1 of the stick 1.

At this moment, the thrust shaft 21 is in the low position, and the minimum distance between the outer surface of the rollers 22 carried by the shaft 21 and the plane P defined by the axes of the drive and positioning shafts is equal to the radius of the powder stick 1.

The powder stick 1 carrying its slits 7 is then retrieved in a collecting bin 54 carried by the frame 11 of the apparatus 10. The thrust shaft rises again to the high position and the barrel 45 delivers a new powder stick between the drive and positioning shafts.

The apparatus according to the invention is particularly suited for inclusion in a continuous manufacturing line for propellent powders in the form of multi-perforated sticks after the station in which the sticks are cut to the desired length.

The following examples illustrate certain possibilities of using powders according to the invention.

EXAMPLE 1

Propellant powders in the form of divided sticks according to the invention were tested in two guns which allow the achievement of more than 19 MJ of energy at the muzzle: an artillery gun for curved fire and an artillery gun for flat trajectory fire.

Test No. 1

For the curved fire gun, double-based propellant powders containing nitrocellulose and nitroglycerine and with 19-hole multi-perforation, with a potential of 900 cal/g, that is 3770 J/g, were used. The sticks had a length of 143 mm and the slits, with a geometrical configuration similar to that of FIG. 3, were spaced by 20 mm. An energy at the muzzle of 19.3 MJ was obtained at a maximum pressure of 336 MPa with pressure waves of between +32 MPa and −13 MPa.

Test No. 2

For the flat trajectory fire gun, double-based propellent powders containing nitrocellulose and nitroglycerine and with 19-hole multi-perforation, with a potential of 1070 cal/g, that is 4460 J/g, were used. The sticks had a length of 500 mm and the slits, with a geometrical configuration similar to that of FIG. 3, were spaced by 25 mm. An energy at the muzzle of 19.0 Mi was obtained at a maximum pressure of 660 mpa with pressure waves of between +150 mpa and zero mpa.

EXAMPLE 2

Powders according to the invention similar to those used in Test No. 2 of Example 1, the slits being spaced by 20 mm, and double-based powders with a geometric configuration similar to that described in the European patent application 0 304 100 and prefragmented to 30 mm were tested in a cylindrical simulator of diameter 50 mm and length 500 mm, fitted with 3 pressure pick-ups and provided with a fracturing disc to cause the pressure to drop.

On stopping the rise in pressure at 100 mpa, a very different behaviour is observed on the depressurised sticks. The sticks according to the invention are in the form of identical unit particles of length approximately 20 mm, whereas the sticks according to the application No. 0 304 100 are not yet fragmented and are still in the form of long sticks.

EXAMPLE 3

3 batches of powder were tested in a simulator of length 155 mm and of volume 3.7 $dm^3$:

Batch A: double-based powder of potential 1070 cal/g, that is 4460 J/g, in the form of 19-hole sticks of length 25 mm placed loose in a combustible container, Batch B: similar to batch A Batch C: double-based powder of potential 1070 cal/g, that is 4460 J/g, in the form of 19-hole sticks of length 130 mm, divided by slits spaced by 25 mm and also placed in a combustible container.

The development of the pressure rate dp/dt as a function of the pressure P for these three batches has been shown in FIG. 13. The curves A, B and C correspond to batches A, B and C respectively.

From these various examples it emerges that powders in stick form, according to the invention, have a combustion behaviour similar to that of elementary-particle powders due to a good fragmentation from the start of combustion. However, due to their configuration in the form of elongate sticks, they allow the insertion, in a given volume, of a greater quantity of energizing material than is possible with loose particles.

We claim:

1. A multi-perforated stick (1) of propellant powder having a cylindrical shape and an outer surface (2), bases (3,4), of thickness (e), generatrices having a length (L), said length being at least equal to three times said thickness (e) of said bases, said stick having a central channel (5) parallel to said generatrices, a plurality of peripheral channels (6) parallel to said central channel and disposed between said central channel (5) and said outer surface (2), and comprising radial slits (7) perpendicular to said generatrices and formed starting from the outer surface (2) of said stick, said slits (7) being continuous over said entire outer surface (2) and having such a depth (p) that they cut at least some of said peripheral channels (6) but they allow a continuous cover (8) of propellant material to remain at least around said central channel (5).

2. The stick according to claim 1 wherein said slits (7) are incisions, said incisions being made without removal of propellant powder.

3. The stick according to claim 1 which is in shape of a cylinder of revolution.

4. The stick according to claim 1, wherein said slits (7) allow the continuous cover (8) of propellant material to remain only around said central channel (5).

5. The stick according to claim 1 wherein said slits (7) are arranged at a distance, said distance separating two consecutive slits being between 1 to 3 times said thickness (e) of the base of the stick.

6. The stick according to claim 1 which separates itself on combustion at the sites of said peripheral slits (7).

* * * * *